US007506825B2

(12) United States Patent
Gibson et al.

(10) Patent No.: US 7,506,825 B2
(45) Date of Patent: Mar. 24, 2009

(54) FUEL INJECTOR CONTROL SYSTEM

(75) Inventors: Dennis H. Gibson, Chillicothe, IL (US); Mark F. Sommars, Sparland, IL (US); Jinhui Sun, Bloomington, IL (US); Mohammad S. Dar, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 273 days.

(21) Appl. No.: 11/443,315

(22) Filed: May 31, 2006

(65) Prior Publication Data

US 2007/0277784 A1 Dec. 6, 2007

(51) Int. Cl.
*F02M 59/00* (2006.01)

(52) U.S. Cl. ..... 239/533.2; 123/446; 239/533.1; 239/533.3

(58) Field of Classification Search ..... 123/445; 239/533.1–533.15, 585.1–585.4, 584, 900, 239/583, 88, 96
See application file for complete search history.

(56) References Cited

U.S. PATENT DOCUMENTS

| | | | | |
|---|---|---|---|---|
| 3,501,099 | A * | 3/1970 | Benson | 239/584 |
| 5,165,653 | A | 11/1992 | Weber | |
| 5,417,142 | A | 5/1995 | Lohmann | |
| 5,775,599 | A * | 7/1998 | Smith et al. | 239/585.3 |
| 5,779,149 | A * | 7/1998 | Hayes, Jr. | 239/124 |
| 6,021,760 | A | 2/2000 | Boecking | |
| 6,499,464 | B2 | 12/2002 | Rueger | |
| 6,719,264 | B2 | 4/2004 | Mattes | |
| 6,840,466 | B2 | 1/2005 | Igashira et al. | |
| 2005/0022793 | A1 | 2/2005 | Takemoto | |

FOREIGN PATENT DOCUMENTS

| | | |
|---|---|---|
| DE | 19826719 | 12/1999 |
| DE | 100 37 527 | 2/2001 |
| EP | 0 816 670 | 1/1998 |
| EP | 1 388 666 | 2/2004 |

OTHER PUBLICATIONS

Mamoru Oki et al., SAE Technical Paper Series 2006-01-0274, "180MPa Piezo Common Rail System", 2006 World Congress, Detroit, Michigan (Apr. 3-6, 2006), www.sae.org.
PCT International Search Report; Applicant Ref. No. 06-235; International Application No. PCT/US2007/008496; International Filing Date: Apr. 4, 2007; Priority Date: May 31, 2006; Applicant: Caterpillar Inc.

* cited by examiner

*Primary Examiner*—Stephen K Cronin
*Assistant Examiner*—Keith Coleman
(74) *Attorney, Agent, or Firm*—Finnegan, Henderson, Farabow, Garrett & Dunner

(57) ABSTRACT

A control system for a fuel injector is disclosed. The control system has a nozzle member with at least one orifice, and a needle check valve. The needle check valve is recipratingly disposed to open and close the at least one orifice. The control system also has a control chamber located at the base end of the needle check valve, and a control valve movable to selectively drain and fill the control chamber. The control system further has an injector body, a first piston located within the injector body, and a second piston located within the injector body. The first piston is operatively connected to the control valve to move the control valve. The second piston is located a distance from the first piston to form a coupling chamber. The control system additionally has a partial-ball check valve associated with the coupling chamber to selectively replenish the coupling chamber.

20 Claims, 3 Drawing Sheets

FUEL INJECTOR CONTROL SYSTEM

TECHNICAL FIELD

The present disclosure is directed to a control system and, more particularly, to a control system for a fuel injector.

BACKGROUND

Fuel injectors provide a way to introduce fuel into the combustion chambers of an engine. One type of fuel injector is known as the common rail fuel injector. A typical common rail fuel injector includes a nozzle assembly having a cylindrical bore with a nozzle outlet at one end, and a nozzle supply passageway in communication with a high pressure fuel rail at an opposite end. A needle check valve is reciprocatingly disposed within the cylindrical bore and spring-biased toward a closed position at which the nozzle outlet is blocked. To inject fuel, the needle check valve is moved to open the nozzle outlet, thereby allowing high pressure fuel to travel from the high pressure rail through the nozzle supply passageway and spray into the associated combustion chamber.

One way to move the needle check valve between the open and closed positions includes draining and filling a control chamber associated with a base of the needle check valve. In particular, the control chamber may be filled with pressurized fuel to retain the needle check valve in a closed position, and selectively drained of the pressurized fuel to bias the needle check valve toward the open position.

A piezo device is often hydraulically coupled to the control chamber to affect draining and filling of the control chamber. Specifically, the piezo device is typically mechanically connected to a first piston, which is separated from a second piston by a space filled with fuel known as a hydraulic coupling. The hydraulic coupling is used to accommodate manufacturing tolerances, heat expansion of the injector components, and/or amplification of force or movement of the piezo device. As the piezo device is charged and expands to move the first piston, the fuel pressure of the hydraulic coupling increases, resulting in movement of the second piston. The second piston then presses against and opens a control valve, thereby draining the control chamber. As long as the hydraulic coupling remains pressurized to the correct pressure, expansion and contraction of the piezo device result in accurate fuel injection events. However, if fuel leaks from the hydraulic coupling and is not replenished, movement of the piezo device can result in undesired or no movement of the control valve.

One example of replenishing the hydraulic coupling is described in U.S. Pat. No. 6,840,466 (the '466 patent) issued to Igashira et al. on Jan. 11, 2005. The '466 patent describes a common rail fuel injector having a check valve installed on a lower end of the first piston. The check valve works to compensate for a loss of fuel due to leakage, by connecting a sump with a displacement amplifying chamber (e.g., the hydraulic coupling described above). The check valve consists of a flat valve closing a passage in the first piston between the sump and the displacement amplifying chamber, and a conical spring urging the flat valve upwards to block the passage. The flat valve is made of a thin disc, which has a pinhole formed in the center thereof. The pinhole serves to allow the leakage of fuel from within the displacement amplifying chamber to the sump in the event of a failure during injection, thereby stopping the injection. The pinhole also serves as a vacuum in the displacement amplifying chamber for removing bubbles from the chamber.

Although the flat check valve included with the fuel injector of the '466 patent may sufficiently replenish fuel leaked from the displacement amplifying chamber, it may have limited application. In particular, because the flat check valve includes a hole through which fuel may leak during injection events, it may be difficult to build significant pressure within the displacement amplifying chamber. In fact, as described in the '466 patent, the hole may even act as a vacuum, directly acting against the buildup of pressure within the chamber. This reduced level of pressure may limit control valve movement and/or force amplification, and the resulting injection pressure available from the injector. In addition, even if significant pressure buildup was possible within the injector of the '466 patent, the flat nature of the check valve may provide too little support against the pressure, possibly resulting in deformation of the check valve and/or failure of the injector.

An alternative embodiment of the injector of the '466 patent is disclosed in SAE TECHNICAL PAPER SERIES 2006-01-0174, entitled "180MPa Piezo Common Rail System." As illustrated in FIG. 6 of this paper, the above-described fuel injector is fitted with a more robust full ball check valve, instead of the flat check valve described in the '466 patent.

Although the full ball check valve may be more robust and, thus, may withstand greater pressures, it may still be problematic. In particular, the full ball check valve may require a greater volume to accommodate the increased size of the full ball check valve. This increased volume may add to the volume of the displacement amplifying chamber, which must be pressurized by the downward displacing movement of the first piston. If the displacing movement of the piezo device is kept the same, the greater volume will result in a lower pressure within the chamber. If the displacing movement of the piezo device is increased, component cost and size of the injector must also be increased.

The control system of the present disclosure solves one or more of the problems set forth above.

SUMMARY OF THE INVENTION

One aspect of the present disclosure is directed to a control system for a fuel injector. The control system includes a nozzle member having at least one orifice, and a needle check valve having a base end and a tip end. The needle check valve is recipratingly disposed within the nozzle member to open and close the at least one orifice. The control system also includes a control chamber located at the base end of the needle check valve, and a control valve movable to selectively drain and fill the control chamber. The control system further includes an injector body, a first piston located within the injector body, and a second piston located within the injector body. The first piston is operatively connected to the control valve to move the control valve. The second piston is located a distance from the first piston to form a coupling chamber. The control system additionally includes a partial-ball check valve associated with the coupling chamber to selectively replenish the coupling chamber.

Another aspect of the present disclosure is directed to a method of injecting fuel into a combustion chamber of an engine. The method includes always directing pressurized fuel to a tip of a fuel injector during operation of the fuel injector, and always directing pressurized fuel to a first chamber of the fuel injector during operation of the fuel injector. The method also includes decreasing the volume of a second chamber of the fuel injector to pressurize fuel therein. Pressurization of the fuel within the second chamber results in pressure reduction within the first chamber and subsequent injection of fuel into the combustion chamber. The method further includes directing fuel from the first chamber to the second chamber, and preventing fuel from flowing from the second chamber to the first chamber.

DETAILED DESCRIPTION

Figure 1:
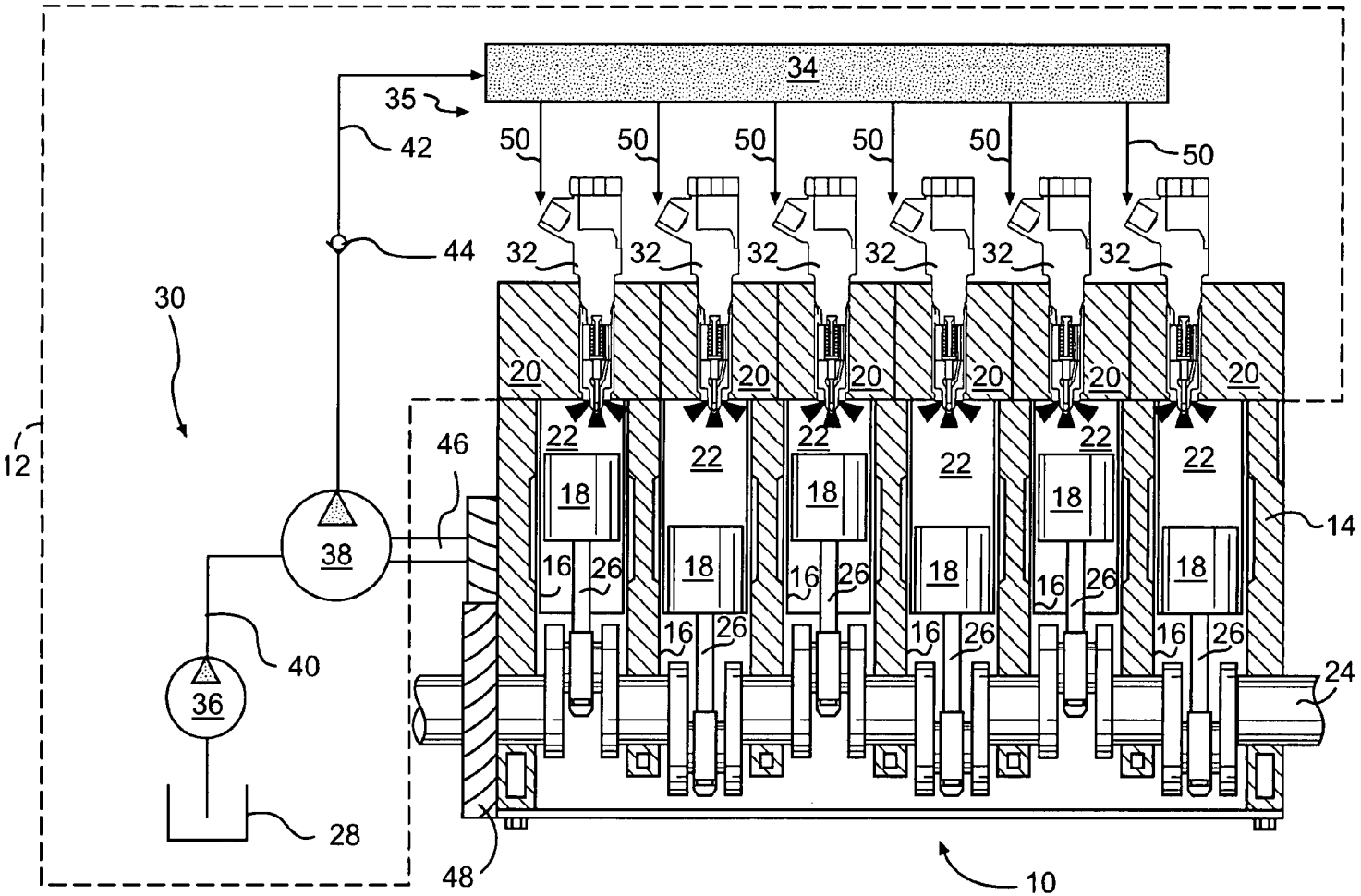
FIG. 1 is a schematic and diagrammatic illustration of an exemplary disclosed fuel system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, a fuel pumping arrangement 30 configured to pressurize the fuel and direct the pressurized fuel to a plurality of fuel injectors 32 by way of a common rail 34.

Fuel pumping arrangement 30 may include one or more pumping devices that function to increase the pressure of the fuel and direct one or more pressurized streams of fuel to common rail 34. In one example, fuel pumping arrangement 30 includes a low pressure source 36 and a high pressure source 38 disposed in series and fluidly connected by way of a fuel line 40. Low pressure source 36 may be a transfer pump configured to provide low pressure feed to high pressure source 38. High pressure source 38 may be configured to receive the low pressure feed and to increase the pressure of the fuel to the range of about 30-300 MPa. High pressure source 38 may be connected to common rail 34 by way of a fuel line 42. A check valve 44 may be disposed within fuel line 42 to provide for one-directional flow of fuel from fuel pumping arrangement 30 to common rail 34.

One or both of low pressure and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Figure 2:
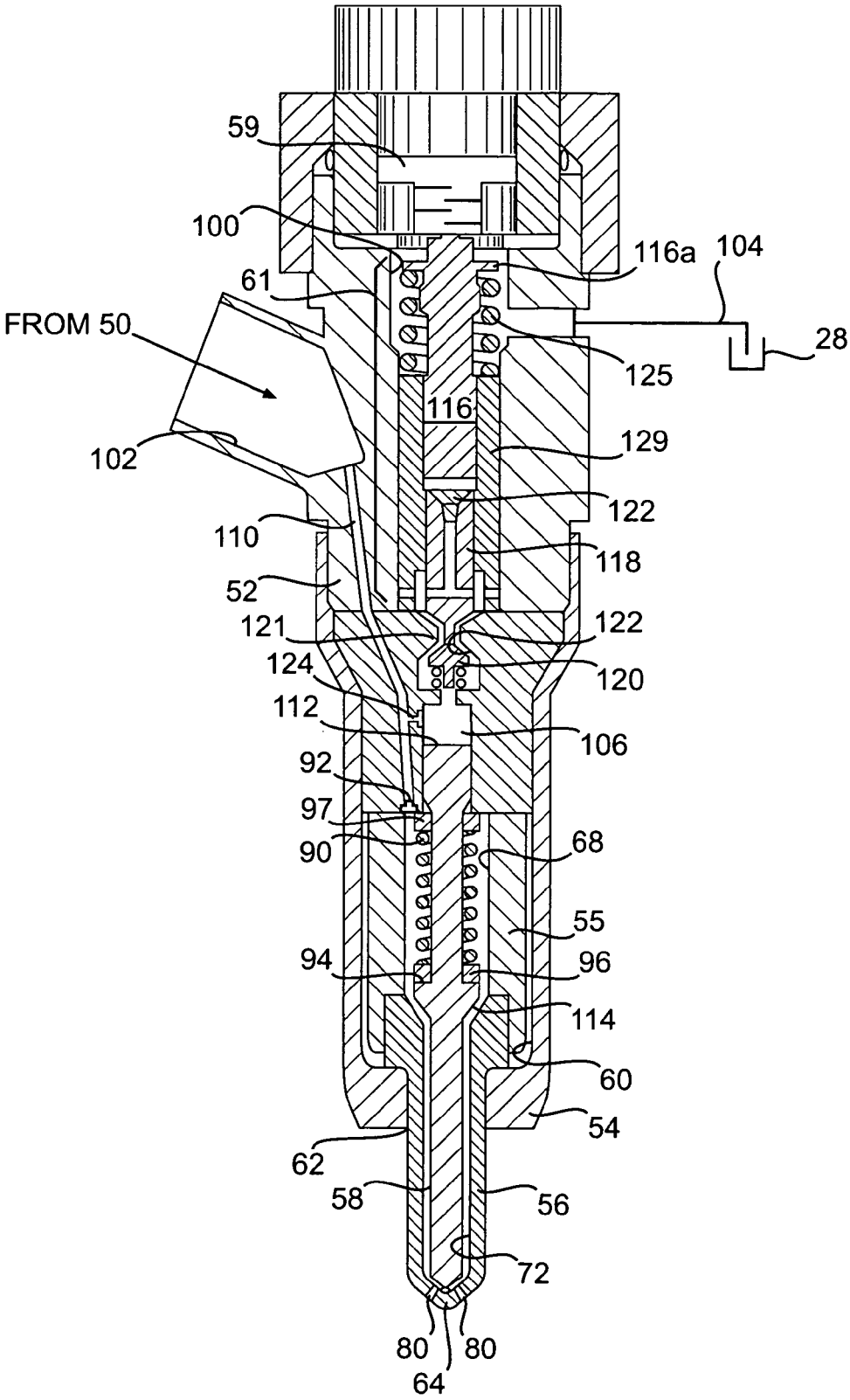
FIG. 2 is a cross-sectional illustration of an exemplary disclosed fuel injector for use with the fuel system of FIG. 1.

As illustrated in FIG. 2, each fuel injector 32 may embody a closed-nozzle unit fuel injector. Specifically, each fuel injector 32 may include an injector body 52, a housing 54 operably connected to injector body 52, a guide 55 disposed within housing 54, a nozzle member 56, a needle valve element 58, an actuator 59, and an actuator valve assembly 61. It is contemplated that additional components may be included within fuel injector 32 such as, for example, restricted orifices, pressure-balancing passageways, accumulators, and other injector components known in the art.

Injector body 52 may embody a cylindrical member configured for assembly within cylinder head 20 and having one or more passageways. Specifically, injector body 52 may include a central bore 100 configured to receive actuator 59, a fuel inlet 102 and outlet 104 in communication with central bore 100, and a control chamber 106. Control chamber 106 may be in direct communication with a base end of needle valve element 58 and selectively drained of or supplied with pressurized fuel to affect motion of needle valve element 58. Injector body 52 may also include a supply passageway 110 that always fluidly communicates fuel inlet 102 with nozzle member 56 and control chamber 106 during operation of fuel injector 32.

Housing 54 may embody a cylindrical member having a central bore 60 for receiving guide 55 and nozzle member 56, and an opening 62 through which a tip end 64 of nozzle member 56 protrudes. A sealing member such as, for example, an o-ring (not shown) may be disposed between guide 55 and nozzle member 56 to restrict fuel leakage from fuel injector 32.

Guide 55 may also embody a cylindrical member having a central bore 68 configured to receive needle valve element 58 and a return spring 90. Return spring 90 may be disposed between a stop 92 and a seating surface 94 to axially bias needle valve element 58 toward tip end 64. A spacer 96 and a similar spacer 97 may be disposed between return spring 90 and seating surface 94 and between return spring 90 and stop 92, respectively, to reduce wear of the components within fuel injector 32. Central bore 68 may function as a pressure chamber and hold pressurized fuel supplied from supply passageway 110 in anticipation of an injection event.

Nozzle member 56 may likewise embody a cylindrical member having a central bore 72 in communication with central bore 68. Central bore 72 may receive needle valve element 58 and include one or more orifices 80 that pass the pressurized fuel from central bore 68 through central bore 72 into combustion chambers 22 of engine 10, as needle valve element 58 is moved away from orifices 80.

Needle valve element 58 may be an elongated cylindrical member that is slidingly disposed within guide 55 and nozzle member 56. Needle valve element 58 may be axially movable between a first position at which a tip end of needle valve element 58 blocks a flow of fuel through orifices 80, and a second position at which orifices 80 are open to spray fuel into combustion chamber 22. It is contemplated that needle valve member 58 may be a multi-member element having a needle member and a piston member or a single integral element.

Needle valve element 58 may have multiple driving hydraulic surfaces. For example, needle valve element 58 may include a hydraulic surface 112 tending to drive needle valve element 58, with the bias of return spring 90, toward a first or orifice-blocking position when acted upon by pressurized fuel. Needle valve element 58 may also include a hydraulic surface 114 that opposes the bias of return spring 90 to drive needle valve element 58 in the opposite direction toward a second or orifice-opening position when acted upon by pressurized fuel.

Actuator 59 may be disposed opposite nozzle member 56 to control the forces on needle valve element 58. In particular actuator 59 may include an electro-expansive module such as a piezo electric motor. A piezo electric motor may include one or more stacks of disk-type piezo electric crystals. The crystals may be structures with random domain orientations. These random orientations are asymmetric arrangements of positive and negative ions that exhibit permanent dipole behavior. When an electric field is applied to the stacks of crystals, such as, for example, by the application of a current, the stacks expand along the axis of the electric field as the domains line up. In one embodiment, the expansion of actuator 59 may be about 40 μm.

Actuator 59 may be connected to needle valve element 58 by way of actuator valve assembly 61. In particular, actuator valve assembly 61 may include a first piston 116, a second piston 118, and a control valve element 120. A check valve 119 may be disposed between first piston 116 and second piston 118 to provide unidirectional flow of fuel from control chamber 106 to a hydraulic coupling 123.

First piston 116 may be connected to move with the expansion and retraction of actuator 59. Specifically, first piston 116 may be retained in mechanical engagement with the crystal stack of actuator 59 by way of a return spring 125. Return spring 125 may be disposed between a flange 116*a* of first piston 116 and a cage element 128. As actuator 59 is charged and expands or de-energized and contracts, first piston 116 may move within central bore 100 to reduce or increase the volume of hydraulic coupling 123. It is contemplated that first piston 116 may be fixedly connected to actuator 59, is desired.

Second piston 118 may be separated from first piston 116 by a distance, thereby forming hydraulic coupling 123. As first piston 116 is moved to decrease the volume of hydraulic coupling 123, the pressure of the fuel within hydraulic coupling 123 may correspondingly increase. The increasing pressure of the fuel within hydraulic coupling 123 may act against an end of second piston 118, thereby urging second piston 118 to move downward against control valve element 120. As first piston 116 is moved to increase the volume of hydraulic coupling 123, the pressure of the fuel within hydraulic coupling 123 may correspondingly decrease, thereby allowing control valve element 120 to return second piston 118 to its original position. It is contemplated that a return spring (not shown) may be associated with second piston 118 to retain second piston 118 in contact with control valve element 120, if desired.

Control valve element 120 may be moved into and out of contact with a seat 122 to selectively drain control chamber 106, thereby initiating the injection of fuel. When control valve element 120 is engaged with seat 122 or in the non-injecting position, fuel may flow from fuel inlet 102 through supply passageway 110 into control chamber 106 via a branch passageway 124. As pressurized fuel builds within control chamber 106, the downward force generated at hydraulic surface 112 combined with the force of return spring 90 may overcome the upward force at hydraulic surface 114, thereby closing orifices 80 and terminating fuel injection. When control valve element 120 is moved against the bias of a return spring 127, out of engagement with seat 122, and into the injecting position, fuel may flow from control chamber 106 to tank 28 via a restricted orifice 121, central bore 100, and fuel outlet 104. As fuel from control chamber 106 drains to tank 28, the upward force at hydraulic surface 114 may urge needle valve element 58 against the bias of return spring 90, thereby opening orifices 80 and initiating fuel injection into combustion chambers 22. When actuator 59 is de-energized, return spring 127 may return control valve element 120 to the non-injecting position.

Check valve 119 may replenish fuel leaked from hydraulic coupling 123. In particular, during operation of fuel injector 32, it may be possible for fuel from within the space between first and second pistons 116, 118 to leak through central bore 100 to fuel outlet 104. If the amount of fuel, and subsequently the pressure, within this space fluctuates, the motion of first piston 116 may result in an undesired motion of second piston 118 and control valve element 120. For example, if hydraulic coupling 123 has leaked fuel, first piston 116 may have to move further to produce the pressure required to initiate movement of second piston 118. In some situations, this additional distance may result in less or even no movement of second piston 118. Check valve 119 may selectively allow fuel from control chamber 106 to replenish the fuel lost from hydraulic coupling 123.

Figure 3:
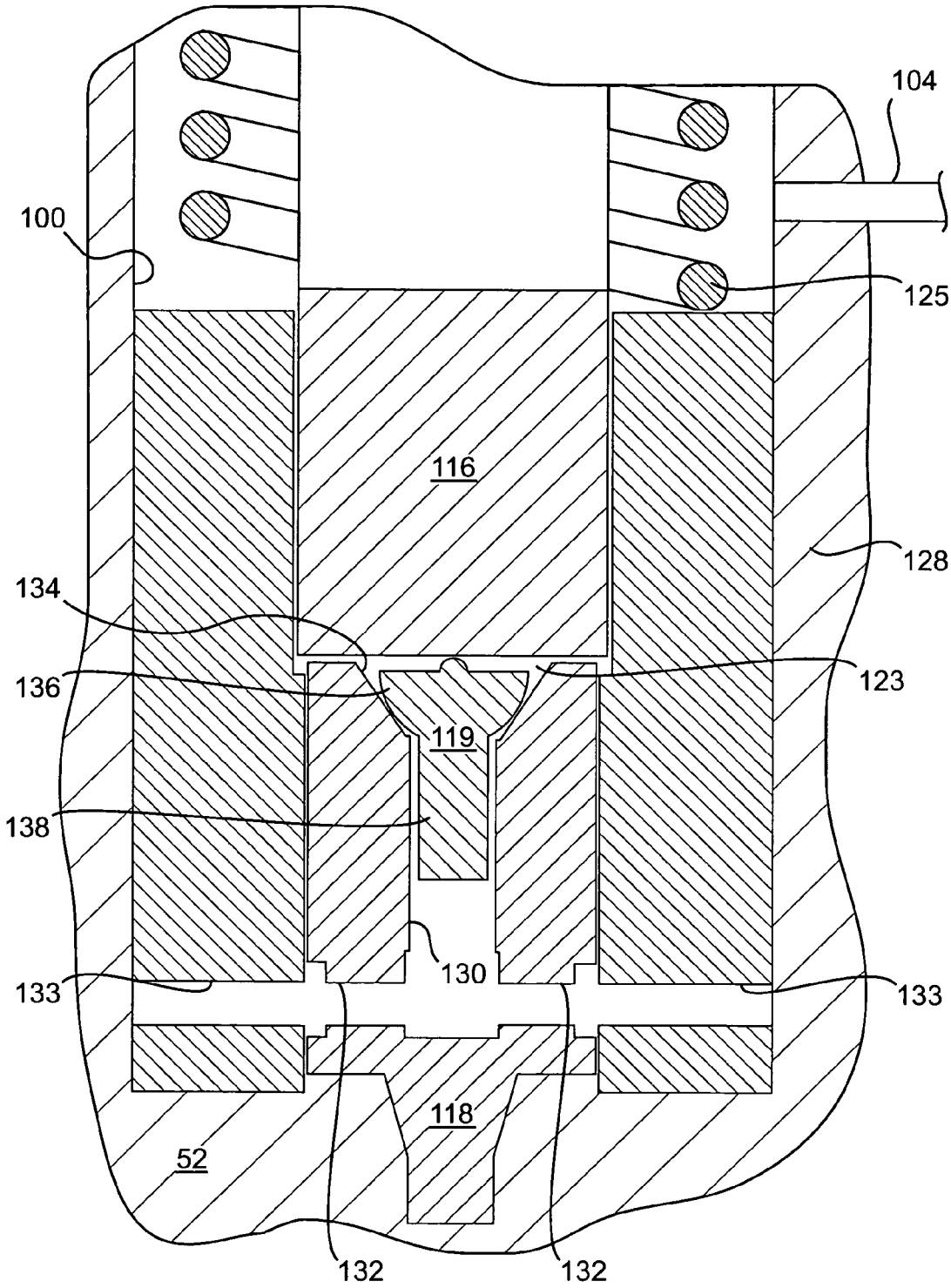
FIG. 3 is a cross-sectional illustration of an exemplary disclosed hydraulic coupling for use with the fuel injector of FIG. 2.

As illustrated in FIG. 3, check valve 119 may be disposed within a central bore 130 of second piston 118. One or more transversely oriented passageways 132 within second piston 118 may cooperate with one or more transversely oriented passageways 133 of cage element 128 to fluidly communicate central bore 130 with central bore 100 and, subsequently, control chamber 106. As the force resulting from fuel pressure within hydraulic coupling 123 acting on check valve 119 decreases below the force resulting from fuel pressure within central bore 130 acting on check valve 119 combined with the force of gravity, check valve 119 may be moved away from a seat 134 to allow fuel to flow from central bore 130 into the space between first and second pistons 116, 118. As the pressures fuel within hydraulic coupling 123 and central bore 130 substantially equalize, check valve 119 may return to its engagement with seat 134.

As also illustrated in FIG. 3, check valve 119 may be robust and guided through its movement along the axial direction of central bore 13. In particular, check valve 119 may include a partial-ball element 136 and a guide element 138. Partial-ball element 136 may include a spherical portion truncated by an upper flat surface. The amount of spherical portion included within partial ball element 136 may be variable and dependent on a particular application. However, in order to provide the structure required to withstand high pressures generated within hydraulic coupling 123, while minimizing the volume required to accommodate partial-ball element 136, the spherical portion utilized in most situations is typically about one half of a full sphere and may be known as a half-ball. A small protrusion may be disposed on the flat surface of partial-ball element 136 to prevent full contact of first piston 116 with the flat surface and to thereby minimize the likelihood of partial-ball element 136 adhering to an end surface of first piston 116.

Guide element 138 may minimize the likelihood of check valve 119 becoming stuck within central bore 130 or the space between first and second pistons 116, 118 during movement of check valve 119. Although check valve 119 is described as being biased by only fuel pressures and gravity, it is contemplated that a return spring (not shown) may alternatively be disposed within central bore 130 or hydraulic coupling 123 to bias check valve 119 and thereby affect the opening or closing pressure differential of check valve 119, if desired. However, the use of a return spring may increase the complexity of check valve 119 and the associated cost and unreliability.

INDUSTRIAL APPLICABILITY

The fuel injector control system of the present disclosure has wide applications in a variety of engine types including, for example, diesel engines, gasoline engines, and gaseous fuel-powered engines. The disclosed fuel injector control system may be implemented into any engine where consistent and predictable fuel injector performance is important. The injection control of fuel injectors 32 will now be described.

Needle valve element 58 may be moved by an imbalance of force generated by fuel pressure. For example, when needle valve element 58 is in the first or orifice-blocking position, pressurized fuel from fuel supply passageway 100 may flow into control chamber 106 to act on hydraulic surface 112. Simultaneously, pressurized fuel from fuel supply passageway 100 may flow into central bores 68 and 72 in anticipation of injection. The force of spring 90 combined with the force generated at hydraulic surface 114 may be greater than an opposing force generated at hydraulic surface 112 thereby causing needle valve element 58 to remain in the first position to restrict fuel flow through orifices 84.

To open orifices 84 and inject the pressurized fuel from central bore 72 into combustion chamber 22, current may be sent to actuator 59 causing an expansion that moves first piston 116 to pressurized hydraulic coupling 123. The increasing pressure of hydraulic coupling 123 may act to move second piston 118 and engaged control valve element 120 such that fuel drains away from control chamber 106 and hydraulic surface 112. This decrease in pressure acting on hydraulic surface 112 may allow the opposing force acting across hydraulic surface 114 to overcome the biasing force of spring 90, thereby moving needle valve element 58 toward the orifice-opening position.

To close orifices 84 and end the injection of fuel into combustion chamber 22, actuator 59 may be de-energized. In particular, as the stack of piezo crystals within actuator 59 contract, first piston 116 may retract from hydraulic coupling 123, resulting in a drop in pressure therein. This reduction in pressure may allow spring 127 to return control valve element 120 and engaged second piston 118 to their flow blocking positions. When control valve element 120 is in the flow blocking position, fuel from control chamber 106 may be prevented from draining to tank 28. Because pressurized fuel is continuously supplied to control chamber 106 via restricted branch passageway 124, pressure may rapidly build within control chamber 106 when drainage therefrom is prevented. The increasing pressure within control chamber 106, combined with the biasing force of spring 90, may overcome the opposing force acting on hydraulic surface 114 to urge needle valve element 58 toward the closed position.

As the pressure of hydraulic coupling 123 decreases due to leakage, check valve 119 may replenish hydraulic coupling 123 with pressurized fuel. In particular, in response to a pressure differential between hydraulic coupling 123 and central bore 130 crossing a predetermined threshold, check valve 119 may move against gravity to allow fuel to flow from central bore 100, through transverse passageways 132, 133 and central bore 130, and into hydraulic coupling 123. In this manner, the non-actuated volume and thus pressure within hydraulic coupling 123 may be kept substantially constant, resulting in substantially constant and predictable injection events.

Check valve 119 may provide high hydraulic coupling pressures and be robust enough to handle the high pressures. In particular, because check valve 119 allows only unidirectional flow of fuel from central bore 130 into hydraulic coupling 123, minimal fuel may leak from hydraulic coupling 123 during the downward displacing movement of first piston 116. By minimizing leakage during this movement to first piston 116, the pressure within hydraulic coupling 123 may increase to a significantly high value at a rate directly proportional to the movement of first piston 116, with minimal efficiency loss. In addition, because of the partial-ball nature of check valve 119, minimal volume within hydraulic coupling 123 is required to accommodate check valve 119. This minimized volume within hydraulic coupling 123 may reduce the travel that first piston 116 must complete in order to pressure hydraulic coupling 123 to the desired pressure. Less travel required of first piston 116 may either reduce the cost of actuator 59 or allow for even higher pressures generated within hydraulic coupling 123. Further, because of the partial-ball nature of check valve 119, check valve 119 may be sturdy enough to withstand these high pressures without deformation or damage.

It will be apparent to those skilled in the art that various modifications and variations can be made to the control system of the present disclosure without departing from the scope of the disclosure. Other embodiments will be apparent to those skilled in the art from consideration of the specification and practice of the control system disclosed herein. It is intended that the specification and examples be considered as exemplary only, with a true scope of the disclosure being indicated by the following claims and their equivalents.

What is claimed is:

1. A control system for a fuel injector, comprising:

a nozzle member having at least one orifice;

a needle check valve having a base end and a tip end, the needle check valve being reciprocatingly disposed within the nozzle member to open and close the at least one orifice;

a control chamber located at the base end of the needle check valve;

a control valve movable to selectively drain and fill the control chamber;

an injector body;

a first piston located within the injector body and operatively connected to the control valve to move the control valve;

a second piston located within the injector body a distance from the first piston to form a coupling chamber; and a partial-ball check valve associated with the coupling chamber to selectively replenish the coupling chamber.

2. The control system of claim 1, wherein the partial-ball check valve only allows unidirectional fuel flow.

3. The control system of claim 1, further including a piezo device mechanically connected to move the second piston.

4. The control system of claim 3, wherein expansion of the piezo device moves the second piston to pressurizes the coupling chamber, resulting in movement of the first piston that drains the control chamber.

5. The control system of claim 3, wherein the partial-ball check valve includes:

a truncated spherical portion; and a guide element disposed within a fuel passageway of the first piston.

6. The control system of claim 5, wherein the fuel passageway is in selective communication with the control chamber.

7. The control system of claim 5, wherein the spherical portion is about one half of a full sphere and is configured to selectively block a flow of fuel from the coupling chamber through the fuel passageway.

8. The control system of claim 1, further including a source of high pressure fuel always in communication with the control chamber.

9. The control system of claim 1, wherein the partial-ball check valve is acted upon by only fuel pressures and gravity.

10. A method of injecting fuel into a combustion chamber of an engine, the method comprising:

always directing pressurized fuel to a tip of a fuel injector during operation of the fuel injector;

always directing pressurized fuel to a first chamber of the fuel injector during operation of the fuel injector;

decreasing the volume of a second chamber of the fuel injector to pressurize fuel therein, wherein pressurization of the fuel within the second chamber results in pressure reduction within the first chamber and subsequent injection of fuel into the combustion chamber;

directing fuel from the first chamber to the second chamber; and preventing fuel from flowing from the second chamber to the first chamber.

11. The method of claim 10, wherein preventing fuel from flowing from the second chamber includes selectively blocking a passageway between the first and second chambers with a partial-ball check valve.

12. The method of claim 11, further including guiding the movement of the partial-ball check along an axial direction of the passageway.

13. A combustion engine, comprising:

at least one cylinder;

a piston associated with the at least one cylinder to form a combustion chamber;

a source of high pressure fuel; and an injector configured to selectively spray fuel into the combustion chamber, the fuel injector including:

a nozzle member having at least one orifice;

a needle check valve having a base end and a tip end, the needle check valve being recipratingly disposed within the nozzle member to open and close the at least one orifice;

a control chamber located at the base end of the needle check valve;

a control valve movable to selectively drain and fill the control chamber;

an injector body;

a first piston located within the injector body and operatively connected to the control valve to move the control valve;

a second piston located within the injector body a distance from the first piston to form a coupling chamber; and a half-ball check valve associated with the coupling chamber to selectively replenish the coupling chamber.

14. The combustion engine of claim 13, wherein the half-ball check valve only allows unidirectional fuel flow and is acted upon by only fuel pressure and gravity.

15. The combustion engine of claim 13, further including a piezo device mechanically connected to move the second piston.

16. The combustion engine of claim 15, wherein expansion of the piezo device moves the second piston to pressurizes the coupling chamber, resulting in movement of the first piston that drains the control chamber.

17. The combustion engine of claim 16, wherein the half-ball check valve includes a guide element disposed within a fuel passageway of the first piston.

18. The combustion engine of claim 17, wherein the fuel passageway is in selective communication with the control chamber.

19. The combustion engine of claim 17, wherein the half-ball check valve is configured to selectively block a flow of fuel from the coupling chamber through the fuel passageway.

20. The combustion engine of claim 13, further including a source of high pressure fuel always in communication with the control chamber.

* * * * *